US006832063B2

(12) United States Patent
Ahn et al.

(10) Patent No.: US 6,832,063 B2
(45) Date of Patent: Dec. 14, 2004

(54) APPARATUS FOR DRIVING DEVELOPERS OF COLOR IMAGE FORMING APPARATUS

(75) Inventors: Byeong-hwa Ahn, Gyeonggi-do (KR); Yu-man Kim, Gyeonggi-do (KR); Young-min Yoon, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/378,594

(22) Filed: Mar. 5, 2003

(65) Prior Publication Data

US 2003/0235432 A1 Dec. 25, 2003

(30) Foreign Application Priority Data

Jun. 25, 2002 (KR) ..... 10-2002-0035674

(51) Int. Cl.[7] ..... G03G 15/01
(52) U.S. Cl. ..... 399/223
(58) Field of Search ..... 399/223, 228, 399/54, 222, 236

(56) References Cited

U.S. PATENT DOCUMENTS 5,440,377 A * 8/1995 Izawa et al. ..... 399/236
5,495,327 A * 2/1996 Inomata ..... 399/228
5,585,898 A * 12/1996 Fujii ..... 399/228
5,828,934 A * 10/1998 Tamura et al. ..... 399/228
2002/0098014 A1 * 7/2002 Kitahara ..... 399/222

* cited by examiner

*Primary Examiner*—Susan Lee
(74) *Attorney, Agent, or Firm*—Staas & Halsey LLP

(57) ABSTRACT

A developer driving apparatus which drives a plurality of developing rollers via a gear chain including pivotable gears and one way gears. A reversible driving motor is coupled to a deceleration gear which directly drives a first swing drive gear and drives a second swing drive gear via an odd number of idler gears. Each swing drive gear is rotationally coupled with a respective swing gear having a center of rotation which is pivotable about a center of rotation of the respective swing drive gear. In a first position each swing gear drives one of the plurality of rollers via a respective one way gear and in a second position, each swing gear drives another of the plurality of rollers via a respective one way gear. A solenoid activated lever moves each swing gear between respective first and second positions.

12 Claims, 6 Drawing Sheets

APPARATUS FOR DRIVING DEVELOPERS OF COLOR IMAGE FORMING APPARATUS

CROSS-REFERENCE TO RELATED APPLICATIONS

This application claims benefit of Korean Application No. 2002-35674 filed Jun. 25, 2002 in the Korean Intellectual Property Office, the disclosure of which is incorporated herein by reference.

BACKGROUND OF THE INVENTION

1. Field of the Invention

The present invention relates to an apparatus for driving developers of a color image forming apparatus, and more particularly, to an apparatus for sequentially driving a plurality of developers separated a predetermined distance from a photosensitive body in a color image forming apparatus.

2. Description of the Related Art

In general, an electrophotographic printer such as a color laser printer includes an image forming apparatus which forms an electrostatic latent image on a photosensitive body and develops the electrostatic latent image with toner. Then, the developed image is transferred to paper by a predetermined transfer medium and is pressed and heated to completely fix the image on the paper.

FIG. 1 shows an example of an image forming apparatus of a color printer. Referring to FIG. 1, an image forming apparatus includes a photoreceptive drum 10 which is a photosensitive body, a charger 11 which charges the photosensitive drum 10, a laser scanning unit (LSU) 12 as an exposing unit which forms an electrostatic latent image by scanning light onto the charged photoreceptive drum 10, a development unit 13 which develops the electrostatic latent image with four colors of black (K), yellow (Y), magenta (M), and cyan (C), a transfer belt 14 on which four different color images developed on the photoreceptive drum 10 are sequentially overlapped, a first transfer roller 14*a* which transfers the image developed on the photoreceptive drum 10 to the transfer belt 14, a second transfer roller 14*b* which transfers the image of four overlapping colors on the transfer belt 14 to paper, and a fusing unit 15 which presses and heats the paper to fix the transferred image on the paper. Developing rollers 13*a*-K, 13*a*-Y, 13*a*-M, and 13*a*-C of four developers 13-K, 13-Y, 13-M, and 13-C provided in the development unit 13 are arranged separated by a predetermined gap from the photoreceptive drum 10 and sequentially develop the electrostatic latent image on the photoreceptive drum 10 when a development bias voltage is applied to corresponding developing rollers. Reference numerals 16, 17, 18, and 19 denote a paper cassette for storing a supply of paper, a blade for cleaning the photoreceptive drum 10, an eraser, and a transfer path along which the paper is ejected, respectively.

The image forming apparatus having the above structure performs an image forming process as follows. First, when the charger 11 charges the photoreceptive drum 10, the LSU 12 scans light to form an electrostatic latent image of an image to be developed with the first color. For example, when black is to be developed first, a predetermined bias voltage is applied to the black developing roller 13*a*-K. Then, a development unit driving motor (not shown) drives the developing roller 13*a*-K so that a toner adhering on the outer circumferential surface thereof is transferred to a portion of the photoreceptive drum 10 contacting the developing roller 13*a*-K. The black image developed as above is transferred to the transfer belt 14 via a first transfer nip N1. Next, an electrostatic latent image for the second color is formed through the charging and exposing steps with respect to the photoreceptive drum 10. For example, where yellow is to be developed secondly, a predetermined development bias voltage is applied to the yellow developing roller 13*a*-Y and the developing roller 13*a*-Y is driven to develop the electrostatic latent image on the photoreceptive drum 10. The yellow developed as above is transferred onto the transfer belt 14 to overlap the black image previously transferred to the belt 14. In the same manner, images of the third color, magenta, and the fourth color, cyan, are developed and transferred so that an image having a desired color is completely formed on the transfer belt 14. Thereafter, the completed color image formed on the transfer belt 14 is transferred to paper supplied to a second transfer nip N2 between the transfer belt 14 and the second transfer roller 14*b*. As the paper passes through the fusing unit 15, the color image is heated and pressed to be completely fixed onto the paper.

FIG. 2 is a view showing a structure of a driving apparatus of the development unit of FIG. 1. FIG. 3 is a partial plan view of the driving apparatus of FIG. 2.

Referring to FIGS. 1–3, the developing rollers 13*a*-K, 13*a*-Y, 13*a*-M, and 13*a*-C are arranged around the photoreceptive drum 10 to be sequentially separated from the photoreceptive drum 10 with a predetermined gap. A deceleration gear 31 which is a two-step gear is connected to a pinion gear 30 of a development unit driving motor (not shown). The deceleration gear 31 is connected to developing roller gears 20-K, 20-Y, 20-M, and 20-C via idle gears 32, 33, 34, and 35 and electronic clutches 36. The electronic clutches 36 are provided to correspond to the respective developing rollers 13*a*. The idle gears 32, 33, 34, and 35 are arranged in an appropriate number between the deceleration gear 31 and the electronic clutch 36 to transfer a rotational force of the gear 30 of the development unit driving motor to each of the electronic clutches 36. A first gear 37 connected to the idle gear 32 or 35 and a second gear 38 connected to the developing roller gear 20 are provided at opposite ends of each of the electronic clutches 36, as shown in FIG. 3. When the electronic clutch 36 is turned on, the rotation of the first gear 37 is transferred to the second gear 38 and the developing roller gear 20. When the electronic clutch 36 is turned off, the first gear 37 and the second gear 38 are disconnected.

In the operation of the driving apparatus of the development apparatus having the above structure, when the black developer 13-K is to be used, the development unit driving motor and the gear 30 are rotated clockwise. According to the rotation of the development unit driving gear 30, the first gears 37-K and 37-Y of the electronic clutches 36-K and 36-Y connected to the first idle gear 32 and the first gears 37-M and 37-C of the electronic clutches 36-M and 36-C connected to the second, third, and fourth idle gears 33, 34, and 35 are rotated. Next, when the electronic clutch 36-K for the black developer 13-K is turned on, the rotation of the first gear 37-K is transferred to the second gear 38-K. Accordingly, the developing roller gear 20-K and the developing roller 13*a*-K are driven. Here, a development bias voltage is applied to the developing roller 13*a*-K so that toner on the surface of the developing roller 13*a*-K develops the electrostatic latent image of the photoreceptive drum 10.

Next, to drive the yellow developing roller 13-Y, the development bias voltage applied to the black developing roller 13-K is cut off and the electronic clutch 36-K is turned off. Then, a development bias voltage for yellow is applied to the yellow developing roller 13-Y and the electronic clutch 36-Y is turned on, so that the rotation power of the first gear 37-Y is transferred to the second gear 38-Y. Thus, the developing roller gear 20-Y and the developing roller 13*a*-Y are driven. The development of magenta and cyan are sequentially performed in a similar manner.

However, since the driving apparatus of the developers having the above structure requires a plurality of electronic clutches, a cost for material increases.

SUMMARY OF THE INVENTION

To solve the above and/or other problems, the present invention provides a developer driving apparatus of a color image forming apparatus which sequentially drives developers by a mechanical means instead of an electronic clutch.

Additional aspects and advantages of the invention will be set forth in part in the description which follows, and, in part, will be obvious from the description, or may be learned by practice of the invention.

According to an aspect of the present invention, a developer driving apparatus of a color image forming apparatus sequentially drives a plurality of developers for developing an electrostatic latent image formed on a photoreceptor body into predetermined colors. The developer driving apparatus comprises a reversible development unit driving motor which drives a developing roller of the developer, a deceleration gear which is rotated by being engaged with a gear of the development unit driving motor to provide a reduced angular velocity, a plurality of one-way gears which selectively receive a rotational driving force from the deceleration gear and rotate the corresponding developing roller according to a direction of rotation of the deceleration gear. Swing gears are adapted to selectively provide the driving force to the one-way gears by pivoting between the one-way gears. A swing drive gear supports and rotates the swing gear along a circumference of the swing drive gear. A swing arm pivotable about a shaft of the swing drive gear and having a first end connected to a shaft of the swing gear and a second end connected to a pivot unit positions the swing gear for engagement along a circumference of the swing drive gear. The swing arm and the pivot unit enable the swing gear to pivot between the pair of one-way gears according to a state of the pivot unit.

The swing gear pivot unit may comprise a plunger connected to the second end of the swing arm, and a solenoid into which the plunger is retracted and from which the plunger is partially ejected. The swing gear pivot unit may further comprise a spring which provides an elastic force to return the plunger to an original position when the solenoid is turned off. The spring may be positioned between the second end of the swing arm and the solenoid.

As the plunger is retracted into the solenoid when the solenoid is turned on, the swing arm pivots the swing gear from engagement with one of the pair of the one-way gears to engagement with the other of the pair of the one-way gears.

Each one-way gear comprises a first gear engaged with a respective swing gear, a second gear engaged with a respective developing roller gear, and a hub clutch arranged between the first and second gears to transfer a rotation force of the first gear to the second gear only when the first gear is rotated in one direction.

Idle gears are arranged in an odd number between the gear of the development unit driving motor and the swing drive gears to make the direction of rotation of the swing drive gears to be opposite.

The developer to be operated is determined according to the rotating direction of the development unit driving motor and the operation of the pivot unit.

BRIEF DESCRIPTION OF THE DRAWINGS

The above and/or other aspects and advantages of the present invention will become more apparent by describing in detail preferred embodiments thereof with reference to the attached drawings in which.

DESCRIPTION OF THE PREFERRED EMBODIMENTS

Figure 1:
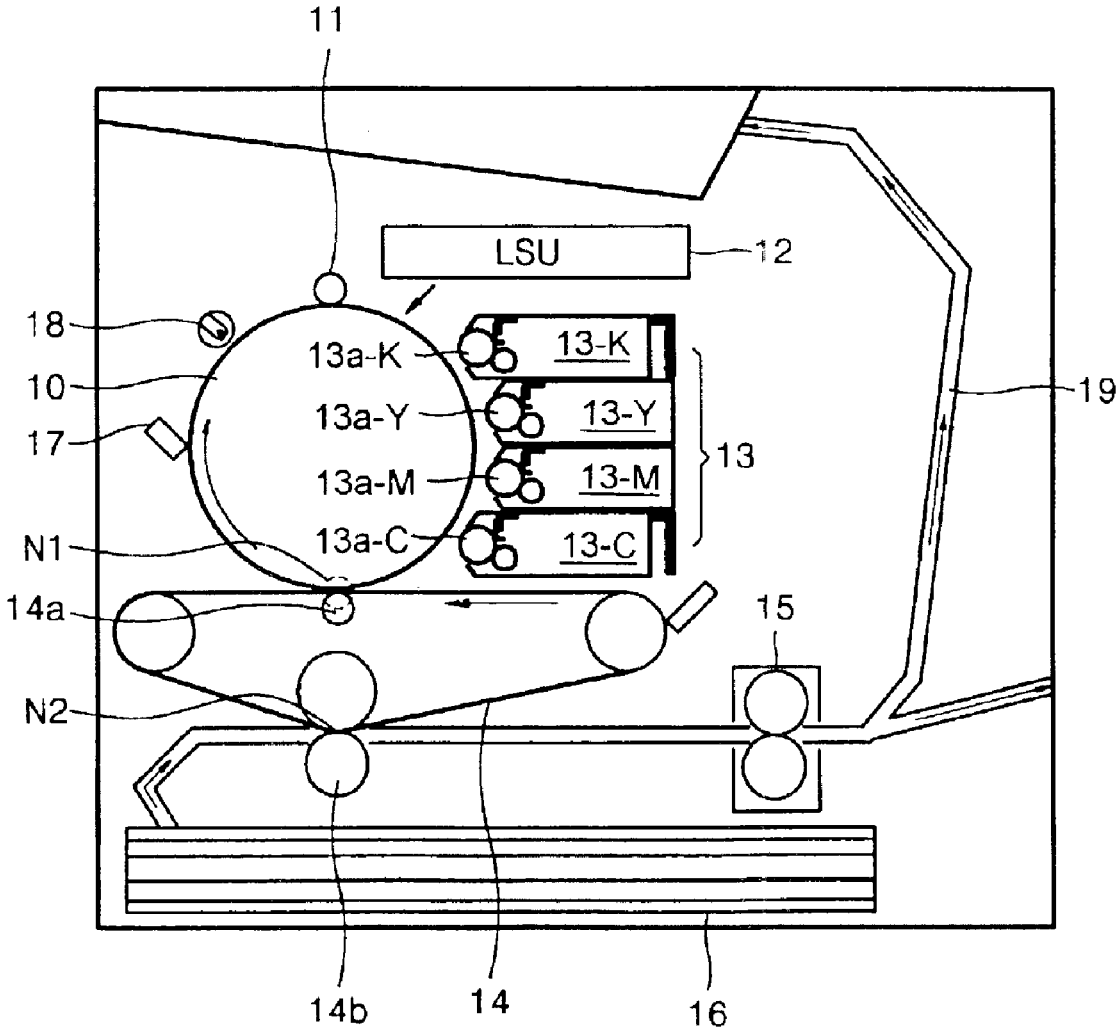
FIG. 1 (PRIOR ART)
FIG. 1 is a view illustrating a typical image forming apparatus of a color printer.
Figure 2:
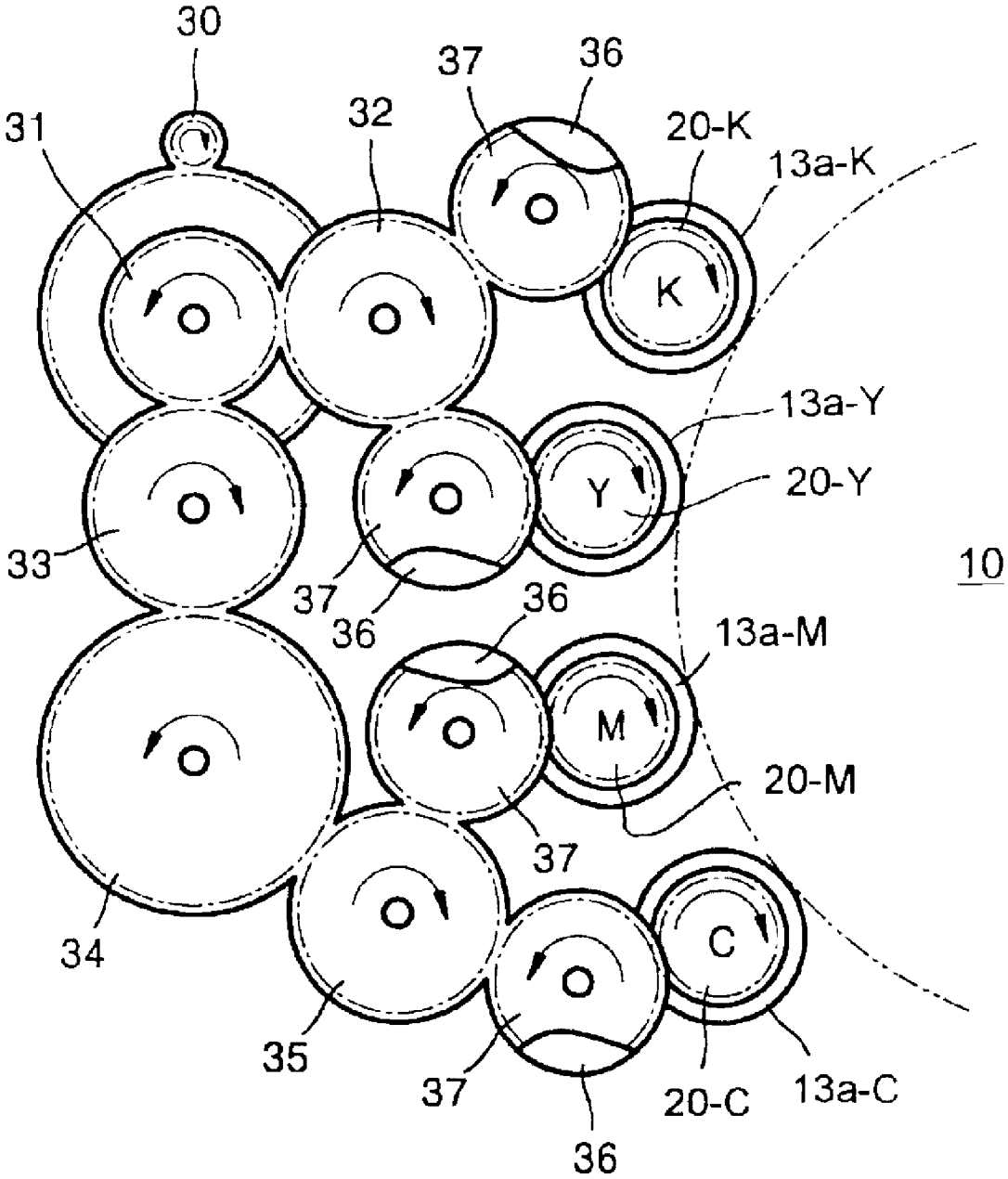
FIG. 2 (PRIOR ART)
FIG. 2 is a view showing illustrating the driving apparatus of the development unit of FIG. 1.
Figure 3:
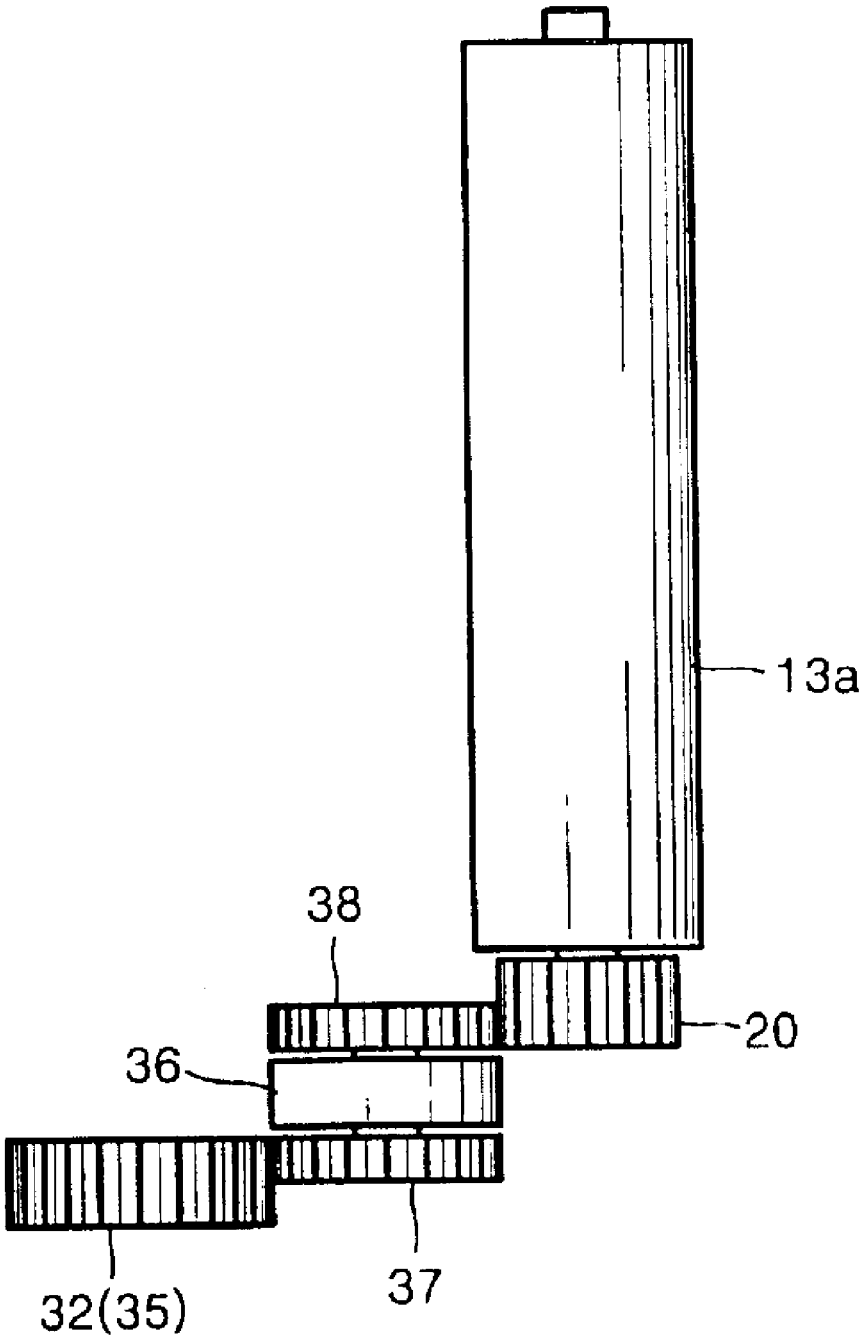
FIG. 3 (PRIOR ART)
FIG. 3 is a partial plan view illustrating a portion of the driving apparatus of FIG. 2.

Reference will now be made in detail to the present embodiments of the present invention, examples of which are illustrated in the accompanying drawings, wherein like reference numerals refer to like elements throughout.

Figure 4:
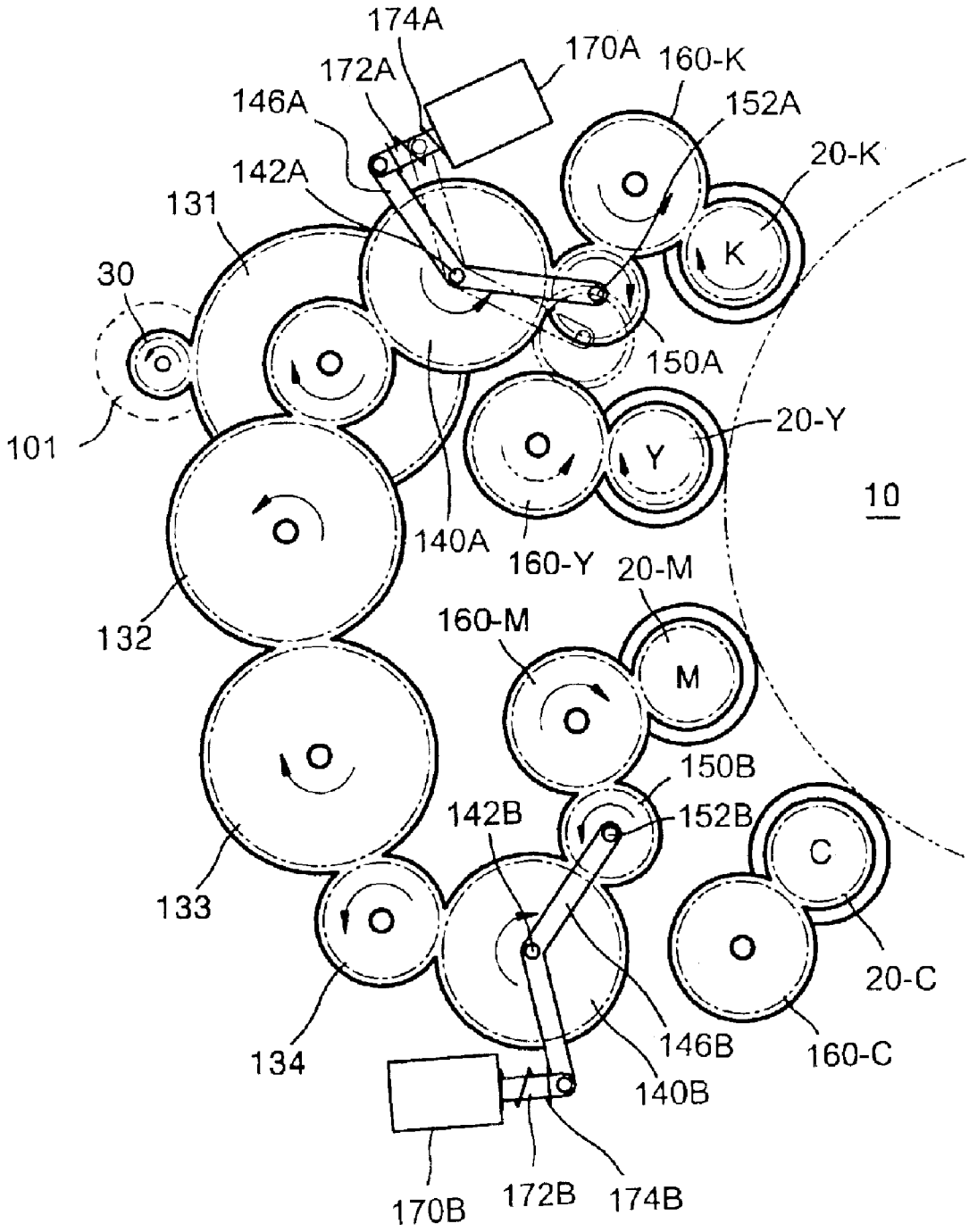
FIG. 4 is a view illustrating a developer driving apparatus of a color image forming apparatus according to an embodiment of the present invention and for explaining an operation of the developer driving apparatus.

FIG. 4 shows the structure of a developer driving apparatus of a color image forming apparatus according to an embodiment of the present invention. Here, the same reference designations are used for elements of the conventional apparatus having the same structure described above, and detailed descriptions thereof are omitted. Also, to aid in understanding the invention, references used for a plurality of elements having the same structure are distinguished by a suffix (K, Y, M, or C) where the elements are associated with a feature corresponding to a particular color of a developer. The suffixes K, Y, M and C correspond to black, yellow, magenta and cyan, respectively. Elements which do not correspond to a particular color and which have the same structure are indicated by a suffix A or B.

The developing rollers 13*a*-K, 13*a*-Y, 13*a*-M, and 13*a*-C are arranged around the photoreceptive drum 10 to sequentially contact a surface of the photoreceptive drum 10. A deceleration gear 131 which is a two-step gear is connected to a pinion gear 30 of a development unit driving motor 101. The deceleration gear 131 is selectively rotationally coupled with the developing roller gears 20-K and 20-Y, via a swing drive gear 140A, a swing gear 150A, and one-way gears 160-K and 160-Y, respectively. The deceleration gear 131 is further selectively rotationally coupled with the developing roller gears 20-M and 20-C via swing drive gear 140B, swing gear 150B, and one-way gears 160-M and 160-C, respectively. Idle gears 132, 133 and 134 are arranged between the deceleration gear 131 and the swing drive gear 140B to adjust the driving arrangement between the developing rollers 13*a*-K, 13*a*-Y, 13*a*-M, and 13*a*-C and the photoreceptive drum 10. Also, an odd number of the idle gears is provided so that respective rotation directions of the swing drive gears 140A and 140B are opposite to each other.

Figure 5:
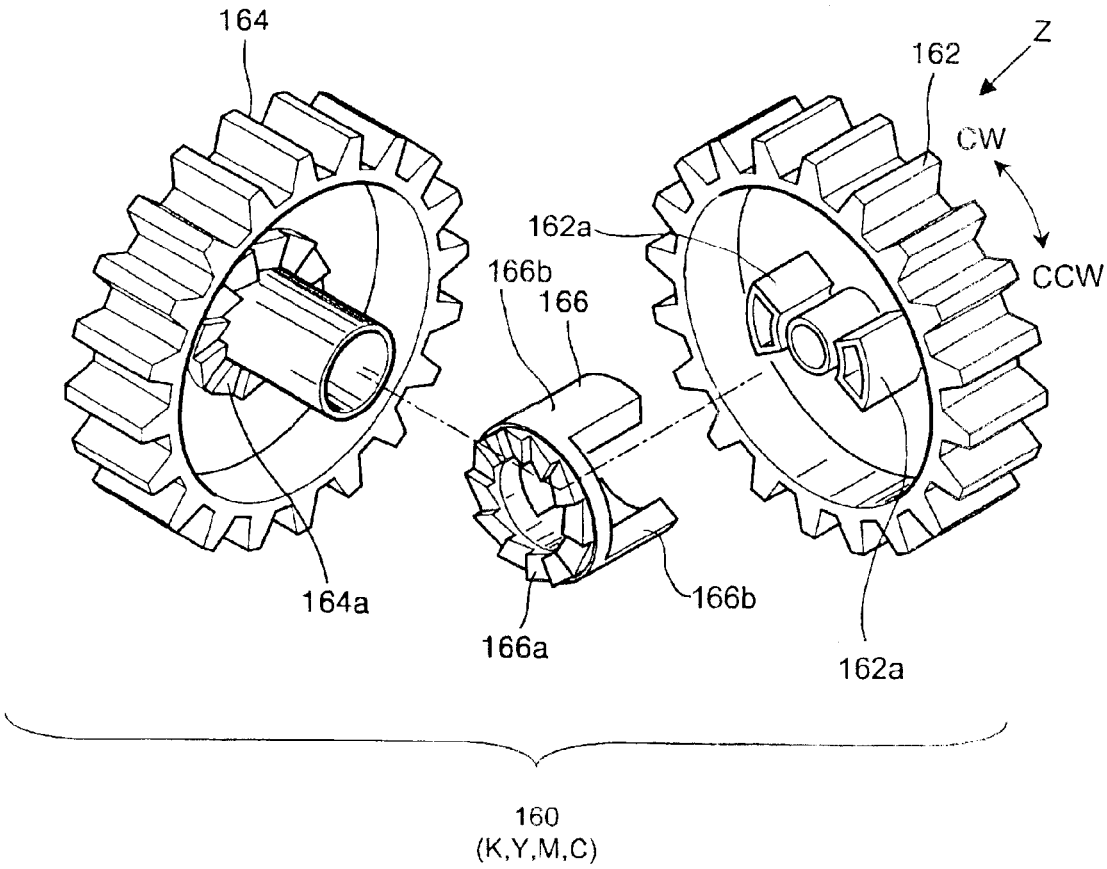
FIG. 5 is an exploded perspective view of a representative one-way gear of the apparatus illustrated in FIG. 4.

Each of the one-way gears 160 (K, Y, M, C) is arranged to correspond to a respective one of the developing roller gears 20 (K, Y, M, C). Referring now to FIG. 5, a representative one of the one-way gears 160 (K, Y, M, or C) will be described. To simplify the description of the representative one of the one-way gears, a suffix corresponding to color will not be used for individual features of the one-way gear, it being understood that the one-way gear shown and described with reference to FIG. 5 may be used for any one of the elements identified as 160-K, 160-Y, 160-M or 160-C in FIGS. 4 and 6.

The one-way gear 160, as shown in FIG. 5, includes a first gear 162 adapted to engage with a respective one of the swing gears 150A or 150B, a second gear 164 adapted to engage a respective one of the developing roller gears 20-K, 20-Y, 20-M and 20-C, and a hub clutch 166 arranged between the first and second gears 162 and 164. Inclined protrusions 164*a* and 166*a* are formed corresponding to each other on an inner surface of the second gear 164 and on one end of the hub clutch 166, respectively. The inclined protrusions 164*a* and 166*a* are formed so that when the first gear 162 rotates clockwise (CW) as viewed in a direction of the arrow Z, the one-way gear 160 does not transfer power of the first gear 162 to the second gear 164 because the protrusions 166*a* of the hub clutch 166 slide along the protrusions 164*a* of the second gear 164. However, when the first gear 162 is rotated counterclockwise (CCW), as viewed in the direction of the arrow Z, the protrusions 166*a* of the hub clutch 166 are engaged with the protrusions 164*a* of the second gear 164 so that the second gear 164 is rotated counterclockwise. Protrusions 166*b* provided on the hub clutch 166 engage protrusions 162*a* provided on the first gear 160 to rotationally couple the first gear 162 and the hub clutch 166. Thus, the one-way gear 160 transfers a rotational force thereof to the second gear 164 according to the rotational direction of the first gear 162.

Referring again to FIG. 4, the swing gear 150A is provided between the swing drive gear 140A and a pair of the one-way gears 160-K and 160-Y corresponding to the swing drive gear 140A. A pivot arm 146A is connected to a shaft 142A of the swing drive gear 140A. A first end of the pivot arm 146A is connected to a shaft 152A of the swing gear 150A to support the swing gear 150A in engagement along an outer circumference of the swing drive gear 140A. A second end of the pivot arm 146A is connected to a plunger 172A of a solenoid 170A. A spring 174A is provided at the plunger 172A to be compressed as the plunger 172A is retracted into the solenoid 170A when the solenoid 170A is turned on. When the solenoid 170A is turned off, the spring 174A provides an elastic force so that the plunger 172A is partially ejected from the solenoid 170A. The swing arm 146A makes the swing gear 150A rotationally engaged with one of the two corresponding one-way gears 160-K and 160Y according to the operation of the solenoid 170A.

A swing gear 150B is provided between the swing drive gear 140B and a pair of the one-way gears 160-M and 160-C corresponding to the swing drive gear 140B. A pivot arm 146B is connected to a shaft 142B of the swing drive gear 140B. A first end of the pivot arm 146B is connected to a shaft 152B of the swing gear 150B to support the swing gear 150B in engagement along an outer circumference of the swing drive gear 140B. A second end of the pivot arm 146B is connected to a plunger 172B of a solenoid 170B. A spring 174B is provided at the plunger 172B to be compressed as the plunger 172B is retracted into the solenoid 170B when the solenoid 170B is turned on. When the solenoid 170B is turned off, the spring 174B provides an elastic force so that the plunger 172B is partially ejected from the solenoid 170B. The swing arm 146B makes the swing gear 150B rotationally engaged with one of the two corresponding one-way gears 160-M and 160C according to the operation of the solenoid 170B.

The operation of the developer driving apparatus of an image forming apparatus having the above structure according to the present invention is described below with reference to FIGS. 4, 5 and 6.

Referring particularly to FIG. 5, in a case of using the black developer 13-K (FIG. 1), when the solenoid 170A is turned off, the swing arm 146A is rotated by the elastic force of the spring 174A with respect to the swing drive gear shaft 142A so that the swing gear 150A engages the one-way gear 160-K. Here, when the development unit driving motor is rotated counterclockwise, the swing gear 150A is rotated clockwise via the gears 131 and 140A. The first gear 162-K of the one-way gear 160-K engaged with the swing gear 150A is rotated counterclockwise. Then, the protrusions 162*a*-K of the hub clutch 166-K are engaged with the protrusions 164*a*-K of the second gear 164-K to rotate the second gear 164-K counterclockwise. Thus, the developer roller gear 20-K engaged with the second gear 164-K is rotated clockwise. Next, the developing roller 13*a*-K to which a development bias voltage is applied develops the electrostatic latent image on the photoreceptive drum 10. Here, the yellow developing roller gear 20-Y being separated from the swing gear 150A does not receive the rotational force of the development unit driving motor 101.

Next, the operation of the magenta developing roller gear 20-M and the cyan developing roller for a counterclockwise rotation of the development unit driving motor 101 and the deceleration gear 131 will be described. The swing gear 150B is rotationally coupled with the deceleration gear 131 via a plurality of the idle gears 132, 133, and 134 and the swing drive gear 140B as described above.

The counterclockwise rotational force of the development unit driving motor 101 rotates the swing gear 150B counterclockwise via the deceleration gear 131 and the idle gears 132, 133 and 134 and the swing drive gear 140B. The swing gear 150B rotates the first gear 162-M of the one-way gear 160-M clockwise. When the first gear 162-M is rotated clockwise, the protrusions 162*a*-M of the hub clutch 166-M slide along the protrusions 164*a*-M of the second gear 164-M and do not transfer the rotational force of the first gear 162-M to the second gear 164-M. Thus, the magenta developing roller gear 20-M is maintained in a stop state. Also, the one-way gear 160-C connected to the cyan developing roller gear 20-C is separated from the swing gear 150B and is maintained in a stop state.

Next, when the yellow developing roller 13*a*-Y is driven, the development bias voltage applied to the black developing roller 20-K is turned off and the solenoid 170A is turned on. The plunger 172A compresses the spring 174A and the plunger 172A is retracted into the solenoid 170A to rotate the swing arm 146A with respect to the shaft 142A of the swing drive gear 140*a*, as indicated by the dashed lines in FIG. 4. Here, the swing gear 150A is engaged with the first gear 162-Y of the one-way gear 160-Y to rotate the first gear 162-Y counterclockwise. Accordingly, the protrusions 162*a*-Y of the hub clutch 166-Y are engaged with the protrusions 164*a*-Y of the second gear so that the second gear 164-Y is rotated counterclockwise. Thus, the developing roller gear 20-Y engaged with the second gear 164-Y is rotated clockwise as shown in FIG. 4. Here, the developing roller 13*a*-Y to which a development bias voltage is applied develops the electrostatic latent image of the photoreceptive drum 10.

In the meantime, the black developing roller gear 20-K and the cyan developing roller gear 20-C are in a stop state, being disengaged from the swing drive gears 150A and 150B, respectively. Also, the magenta developing roller gear 20-M is in a stop state by the operation of the one-way gear 160-M.

Figure 6:
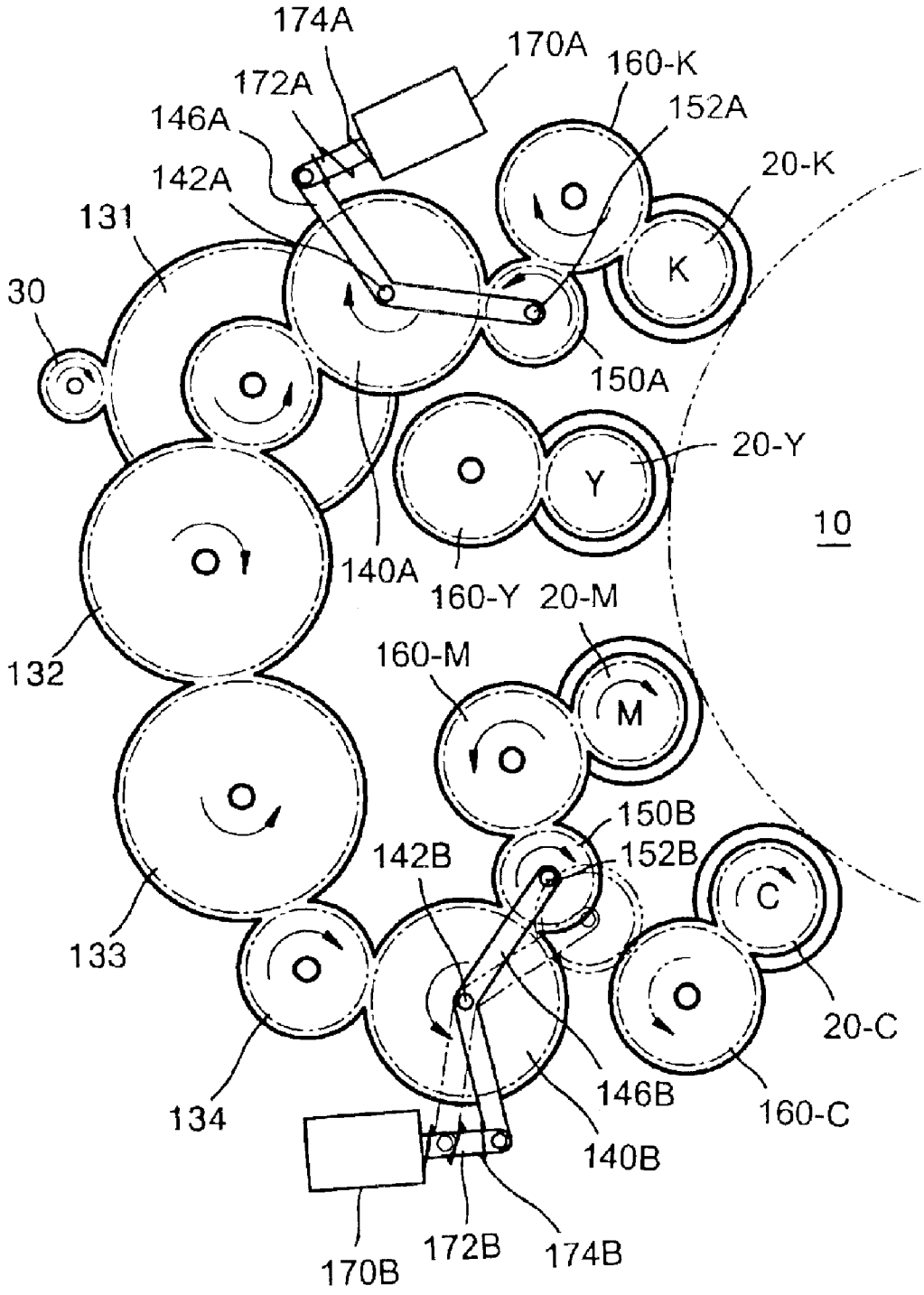
FIG. 6 is a view for further explaining the operation of a developer driving apparatus of a color image forming apparatus according to the present invention.

Referring now to FIG. 6, when the magenta developing roller 13*a*-M is driven, the solenoid 170A is turned off and the swing arm 146A is rotated counterclockwise by the elastic force of the spring 174A and the rotational force of the swing drive gear 140A so that the swing gear 150A is engaged with the one-way gear 160-K. Also, the bias voltage applied to the yellow developing roller 13*a*-Y is turned off. Meanwhile, the development unit driving motor 101 is rotated in a reverse direction, that is, clockwise, to rotate the development unit driving gear 30 clockwise as shown in FIG. 6. The swing gear 150B rotationally engages the one-way gear 160-M in a state in which the solenoid 170B is turned off. Here, the development unit driving motor rotates the swing gear 150B clockwise via the gears 131, 132, 133, 134, and 140B. As the first gear 162*a*-M of the one-way gear 160-M engaged with the swing gear 150B is rotated counterclockwise, the protrusions 166*a*-M of the hub clutch 166-M and the protrusions 164*a*-M of the second gear 164 engage with each other, so that the second gear 164-M is rotated counterclockwise. Thus, the developing roller gear 20-M engaged with the second gear 164-M is rotated clockwise. Next, the developing roller 13*a*-M to which the development bias voltage is applied develops the electrostatic latent image on the photoreceptive drum 10. Meanwhile, the cyan developing roller gear 20-C being separated from the swing gear 150B is maintained in a stop state due to not receiving a rotational force from the development unit driving motor 101.

Next, the operation of the black developing roller 20-K engaged with the swing gear 150A for a clockwise rotation of the development unit driving motor will be described. In this case, the solenoid 170A is turned off.

The clockwise rotational force of the development unit driving motor rotates the swing gear 150A counterclockwise via the swing drive gear 140A. The swing gear 150A rotates the first gear 162-K of the one-way gear 160-K clockwise. When the first gear 162-K is rotated clockwise, the protrusions 162*a*-K of the hub clutch slide along the protrusions 164*a*-K of the second gear so that the rotational force of the first gear 162-K is not transferred to the second gear 164-K. Thus, the black developing roller gear 20-K is maintained in a stop state. Also, the one-way gear 160-Y engaged with the yellow developing roller gear 20-Y, being separated from the swing gear 150A, is maintained in a stop state.

Next, continuing to refer to FIG. 6, when the cyan developing roller 13*a*-C is driven, the development bias voltage applied to the magenta developing roller 13*a*-M is turned off and the solenoid 170B is turned on. The plunger 172B retracts into the solenoid 170B while compressing the elastic spring 174B to rotate the swing arm 150B with respect to the shaft 142B of the swing drive gear 140B. Here, the swing gear 150B engages with the first gear 162-C of the one-way gear 160-C to rotate the first gear 162-C counterclockwise. Accordingly, the protrusions 166*a*-C of the hub clutch 166-C and the protrusions 164*a*-C of the second gear 164 are engaged with each other to rotate the second gear 164-C counterclockwise. Thus, the developing roller gear 20-C engaged with the second gear 164-C rotates clockwise. Here, a development bias voltage is applied to the developing roller 13*a*-C so that toner on the surface of the developing roller 13*a*-C develops the electrostatic latent image of the photoreceptive drum 10.

As described above, the developer driving apparatus of a color image forming apparatus according to the present invention reduces a cost of manufacture of a color image forming apparatus by using inexpensive solenoids and one-way gears.

Although an embodiment of the present invention has been shown and described, it would be appreciated by those skilled in the art that changes may be made in this embodiment without departing from the principles and spirit of the invention, the scope of which is defined in the claims and their equivalents.

What is claimed is:

1. A developer driving apparatus of a color image forming apparatus which sequentially drives a plurality of developers for developing an electrostatic latent image formed on a photoreceptor body into a predetermined color, the developer driving apparatus comprising:

a plurality of developing rollers, each roller corresponding to one of the plurality of developers;

a development unit driving motor adapted to reversibly rotate and having a gear;

a deceleration gear which engages the gear of the development unit driving motor; and a plurality of one-way gears each of which:

selectively receives a rotational driving force from the deceleration gear, and selectively rotates a corresponding one of the plurality of the developing rollers according to a direction of rotation of the deceleration gear.

2. The developer driving apparatus as claimed in claim 1, further comprising:

a swing gear rotationally coupled with the deceleration gear and which pivots between a pair of the one-way gears so each one-way gear selectively receives the driving force from the deceleration gear.

3. The developer driving apparatus as claimed in claim 2, further comprising:

a swing drive gear which rotationally couples the swing gear and the deceleration gear and which supports the swing gear along a circumference of the swing drive gear.

4. The developer driving apparatus as claimed in claim 3, further comprising:

first and second shafts which rotationally support the swing drive gear and the swing gear, respectively, a swing arm connected to the first shaft and having a first end connected to the second shaft and a second end; and a swing gear pivot unit connected to the second end of the swing arm and which drives the swing arm to pivot the swing gear between the pair of the one-way gears.

5. The developer driving apparatus as claimed in claim 4, wherein the swing gear pivot unit comprises:

a plunger connected to the second end of the swing arm; and a solenoid which retracts the plunger to drive the pivot arm when the solenoid is turned on.

6. The developer driving apparatus as claimed in claim 5, further comprising:

a spring which provides an elastic force to return the plunger to an original position when the solenoid is turned off.

7. The developer driving apparatus as claimed in claim 6, wherein:

as the plunger is retracted into the solenoid, the swing arm pivots the swing gear to disengage one of the pair of the one-way gears and to engage the other of the pair of the one-way gears.

8. The developer driving apparatus as claimed in claim 1, wherein each one-way gear comprises:

a first gear which receives the rotational driving force;

a second gear engaged with the corresponding developing roller gear; and a hub clutch arranged between the first and second gears to transfer the rotation force of the first gear to the second gear only when the first gear is rotated in a predetermined direction.

9. The developer driving apparatus as claimed in claim 3, wherein:

the one-way gears are provided in a plurality of pairs of the one way gears; and the developer driving apparatus further comprises:

a plurality of swing gears, a plurality of swing drive gears, each of which selectively drives a pair of the one-way gears, and idle gears arranged in an odd number between the deceleration gear and one of the plurality of the swing drive gears, to make a driving direction of the one of the plurality of swing drive gears opposite to a driving direction of another of the plurality of swing gears.

10. The developer driving apparatus as claimed in claim 4, wherein the developer to be operated is determined according to the rotating direction of the development unit driving motor and the operation of the pivot unit.

11. A developer driving apparatus of a color image forming apparatus which sequentially drives a plurality of developing rollers for developing an electrostatic latent image formed on a photoreceptor body into a predetermined color, the developer driving apparatus comprising:

a reversible motor which provides a rotational force;

a plurality of directional clutches, each clutch having an input gear and an output gear; and a plurality of swing gears, each swing gear selectively transmitting the rotational force to the input gear of one of a pair of the directional clutches;

wherein:

the output gear of each directional clutch transmits the rotational force to a respective one of the plurality of the developing rollers where the respective input gear is rotated in a first direction and interrupts the transmission of the rotational force to the respective developing roller where the respective input gear is rotated in a second direction opposite to the first direction.

12. A developer driving apparatus of a color image forming apparatus which sequentially drives a plurality of developing rollers for developing an electrostatic latent image formed on a photoreceptor body into a predetermined color, the developer driving apparatus comprising:

a reversible motor which provides a rotational force; and a plurality of directional clutches, each of which transmits the rotational force to a respective one of the plurality of the developing rollers where the reversible motor is rotated in a first direction and interrupts the transmission of the rotational force to the respective developing roller where the reversible motor is rotated in a second direction opposite to the first direction.

* * * * *